US009063492B2

(12) United States Patent
Yokoyama

(10) Patent No.: US 9,063,492 B2
(45) **Date of Patent: *Jun. 23, 2015**

(54) FUSER TO PREVENT FLUTTERING OF FIXING BELT

(71) Applicants: KABUSHIKI KAISHA TOSHIBA, Tokyo (JP); TOSHIBA TEC KABUSHIKI KAISHA, Tokyo (JP)

(72) Inventor: Shuji Yokoyama, Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/188,008

(22) Filed: Feb. 24, 2014

(65) Prior Publication Data

US 2014/0169847 A1 Jun. 19, 2014

Related U.S. Application Data

(62) Division of application No. 13/396,216, filed on Feb. 14, 2012, now Pat. No. 8,831,497.

(60) Provisional application No. 61/475,620, filed on Apr. 14, 2011.

(51) Int. Cl.
*G03G 15/20* (2006.01)

(52) U.S. Cl.
CPC ..... *G03G 15/2064* (2013.01); *G03G 15/2053* (2013.01); *G03G 2215/2035* (2013.01)

(58) Field of Classification Search
None
See application file for complete search history.

(56) References Cited

U.S. PATENT DOCUMENTS

| | | | | |
|---|---|---|---|---|
| 7,539,449 | B2 | 5/2009 | Aoki | |
| 8,831,497 | B2 * | 9/2014 | Yokoyama | 399/329 |
| 2006/0029444 | A1 | 2/2006 | Naito et al. | |
| 2007/0212134 | A1 | 9/2007 | Aoki | |
| 2012/0263509 | A1 | 10/2012 | Yokoyama | |
| 2014/0169847 | A1 | 6/2014 | Yokoyama | |

FOREIGN PATENT DOCUMENTS

| | | | |
|---|---|---|---|
| CN | 202583707 | U | 12/2012 |
| JP | 2004239956 | A | 8/2004 |

OTHER PUBLICATIONS

Chinese Office Action dated May 6, 2014 for Application No. 201210100264.5.

* cited by examiner

*Primary Examiner* — Roy Y Yi
(74) *Attorney, Agent, or Firm* — Patterson & Sheridan, LLP

(57) ABSTRACT

A fuser includes a fixing belt that is endless and includes a heat generating layer and circulates, an end restraining member that supports an end of the fixing belt, a heat generating source that is disposed around the fixing belt and heats the heat generating layer, an opposite part that contacts an outer peripheral surface of the fixing belt, a pressure part that is disposed inside the fixing belt and located at a position opposite to the opposite part, and presses the fixing belt to the opposite part side to form a nip between the fixing belt and the opposite part, and a rotation part that contacts an inner peripheral surface of the fixing belt at a position opposite to the heat generating source.

10 Claims, 4 Drawing Sheets

FUSER TO PREVENT FLUTTERING OF FIXING BELT

CROSS-REFERENCE TO RELATED APPLICATION

This application is a Divisional of Non Provisional patent application Ser. No. 13/396,216 filed Feb. 14, 2012, which is based upon and claims the benefit of priority from Provisional U.S. Application 61/475,620 filed on Apr. 14, 2011 the entire contents of which are incorporated herein by reference.

FIELD

Embodiments described herein relate generally to a fuser used in an image forming apparatus and to a fuser to achieve stable running of a fixing belt.

BACKGROUND

As a fuser used in an image forming apparatus such as a copying machine or a printer, there is a fuser which uses a fixing belt having small heat capacity as a heat generating part to save energy of an external heat source, and achieves quick rise. In the fixing belt in which both sides thereof are supported by flanges for rotation running, a tensile force can not be applied to an intermediate area of the fixing belt in a rotation axis direction.

Thus, there is a fear that the intermediate area of the fixing belt which is free in a circumferential direction flutters at the time of rotation running. There is a fear that a gap between the fixing belt and the external heat source such as an induced current generating coil (IH coil) varies, and the fixing belt can not achieve uniform heating temperature.

DETAILED DESCRIPTION

In general, according to one embodiment, a fuser includes a fixing belt that is endless and includes a heat generating layer and circulates, an end restraining member that supports an end of the fixing belt, a heat generating source that is disposed around the fixing belt and heats the heat generating layer, an opposite part that contacts an outer peripheral surface of the fixing belt, a pressure part that is disposed inside the fixing belt and located at a position opposite to the opposite part, and presses the fixing belt to the opposite part side to form a nip between the fixing belt and the opposite part, and a rotation part that contacts an inner peripheral surface of the fixing belt at a position opposite to the heat generating source.

Hereinafter, an embodiment will be described.

Figure 1:
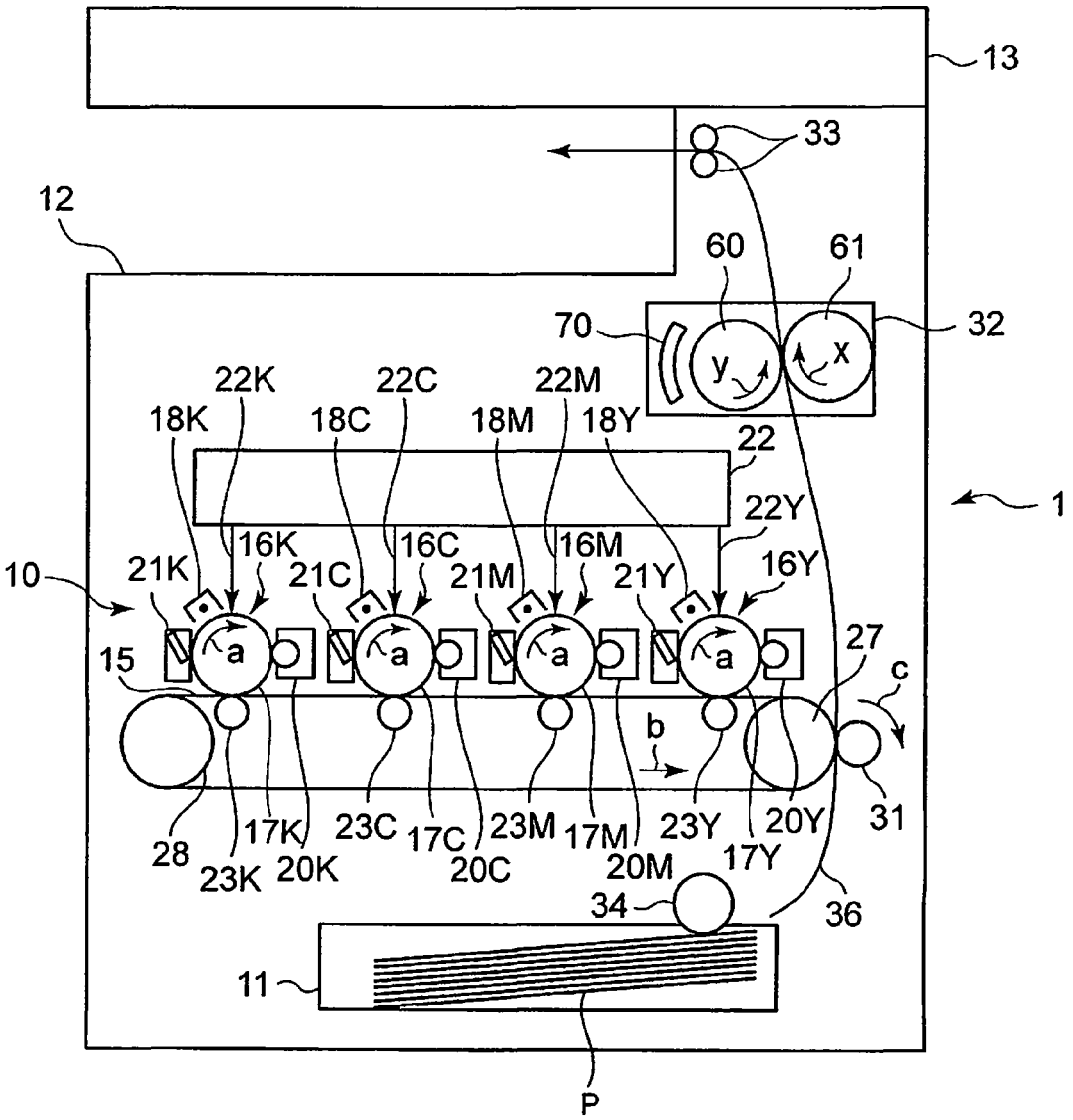
FIG. 1 is a schematic structural view showing an MFP including a fuser of an embodiment.

FIG. 1 is a schematic structural view showing a color MFP (Multi Functional Peripheral) 1 as a tandem type image forming apparatus including a fuser of an embodiment. The MFP 1 includes a printer part 10 as an image forming part, a paper feed part 11 including a pickup roller 34, a paper discharge part 12 and a scanner 13.

The printer part 10 includes four sets of image forming stations 16Y, 16M, 16C and 16K of Y (Yellow), M (Magenta), C (Cyan) and K (black) arranged in parallel along an intermediate transfer belt 15. The respective image forming stations 16Y, 16M, 16C and 16K include photoconductive drums 17Y, 17M, 17C and 17K.

The respective image forming stations 16Y, 16M, 16C and 16K include, around the photoconductive drums 17Y, 17M, 17C and 17K rotating in an arrow a direction, chargers 18Y, 18M, 18C and 18K to uniformly charge surfaces of the photoconductive drums 17Y, 17M, 17C and 17K, developing devices 20Y, 20M, 20C and 20K to develop electrostatic latent images formed on the photoconductive drums 17Y, 17M, 17C and 17K by applying toner, and photoreceptor cleaners 21Y, 21M, 21C and 21K. The printer part 10 includes a laser exposure device 22 constituting an image forming unit. The laser exposure device 22 irradiates laser beams 22Y, 22M, 22C and 22K corresponding to the respective colors to the photoconductive drums 17Y, 17M, 17C and 17K. The laser exposure device 22 irradiates the laser beams and forms the electrostatic latent images on the photoconductive drums 17Y, 17M, 17C and 17K.

The printer part 10 includes a backup roller 27 and a driven roller 28 to support the intermediate transfer belt 15, and the intermediate transfer belt 15 runs in an arrow b direction. The printer part 10 includes primary transfer rollers 23Y, 23M, 23C and 23K at positions opposite to the respective photoconductive drums 17Y, 17M, 17C and 17K through the intermediate transfer belt 15. The respective primary transfer rollers 23Y, 23M, 23C and 23K primarily transfer toner images formed on the photoconductive drums 17Y, 17M, 17C and 17K to the intermediate transfer belt 15 and sequentially superimpose the toner images. The respective photoreceptor cleaners 21Y, 21M, 21C and 21K remove toners remaining on the photoconductive drums 17Y, 17M, 17C and 17K after the primary transfer.

The printer part 10 includes a secondary transfer roller 31 at a position opposite to the backup roller 27 through the intermediate transfer belt 15. The secondary transfer roller 31 is driven by the intermediate transfer belt 15 and rotates in an arrow c direction. At the time of secondary transfer, the printer part 10 forms a transfer bias in a nip between the intermediate transfer belt 15 and the secondary transfer roller 31, and collectively secondarily transfers the toner images on the intermediate transfer belt 15 to a sheet P passing through the nip.

The printer part 10 includes a fusing unit 32 as a fuser and a paper discharge roller pair 33 at the downstream side of the secondary transfer roller 31 along a conveyance path 36.

If a print operation starts in these components, the printer part 10 transfers the formed image to the sheet P as a recording medium fed from the paper feed part 11, and discharges the sheet to the paper discharge part 12 after fixing.

The image forming apparatus is not limited to the tandem type, and the number of the developing devices is not limited. The image forming apparatus may directly transfer a toner image to a recording medium from a photoreceptor.

Figure 2:
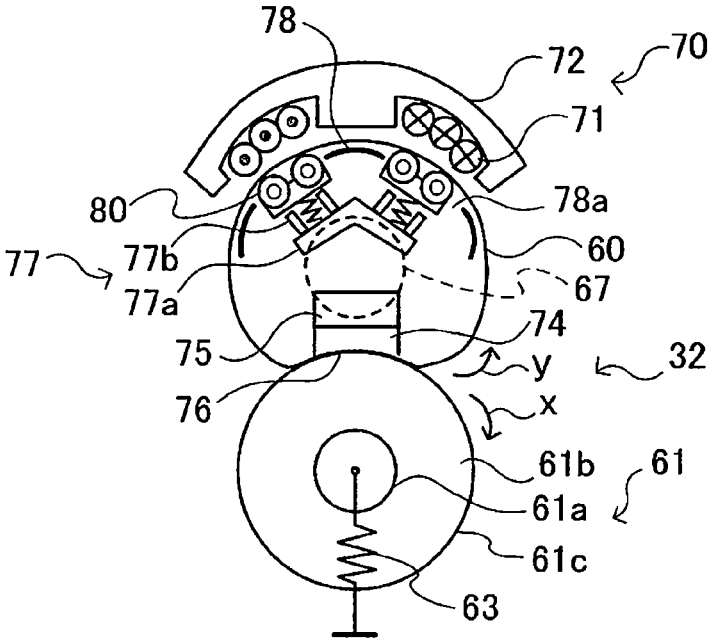
FIG. 2 is a schematic structural view of the fuser viewed from side.

The fusing unit 32 will be described in detail. As shown in FIG. 2, the fusing unit 32 includes a hollow endless fixing belt 60, a press roller 61 as an opposite part, an induced current generating coil (hereinafter referred to as IH coil) 70 as an induced current generating part, a pressure pad 74 as a pressure part, a temperature-sensitive magnetic plate 78 as a magnetic shunt member, a roller 80 as a rotation part in contact with an inner peripheral surface of the fixing belt 60, and a support part 77 of the roller 80.

Figure 3:
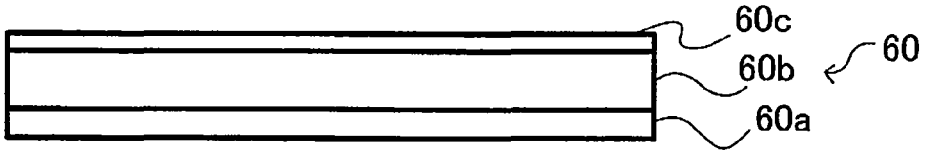
FIG. 3 is a schematic explanatory view showing a layer structure of a fixing belt of the embodiment.

For example, as shown in FIG. 3, the fixing belt 60 is formed by laminating an elastic layer 60*b* and a mold release layer 60*c* on a conductive layer 60*a* as a heat generating layer. The fixing belt has only to include the heat generating layer, and only the mold release layer may be provided on the surface of the heat generating layer. The conductive layer 60*a* generates heat by applying AC current with a frequency of, for example, 20 to 100 kHz to the IH coil 70.

As the conductive layer 60*a*, for example, nickel (Ni), copper (Cu), stainless or the like is used. The elastic layer 60*b* of silicone rubber or the like is provided between the conductive layer 60*a* and the mold release layer 60*c*, so that the fixing property of the fusing unit 32 is improved. As the mold release layer 60*c*, for example, fluorine resin such as PFA resin is used. The thicknesses of the elastic layer 60*b* and the mold release layer 60*c* are selected so as to prevent the heat capacity from becoming excessively large, and warming-up time of the fusing unit 32 is shortened.

The press roller 61 includes, for example, a heat resistant rubber layer 61*b* on a surface of a core metal 61*a*, and includes a mold release layer 61*c* made of fluorine resin such as PFA resin on the surface. The press roller 61 includes a spring 63 to press the press roller 61 to the fixing belt 60 side.

Figure 4:
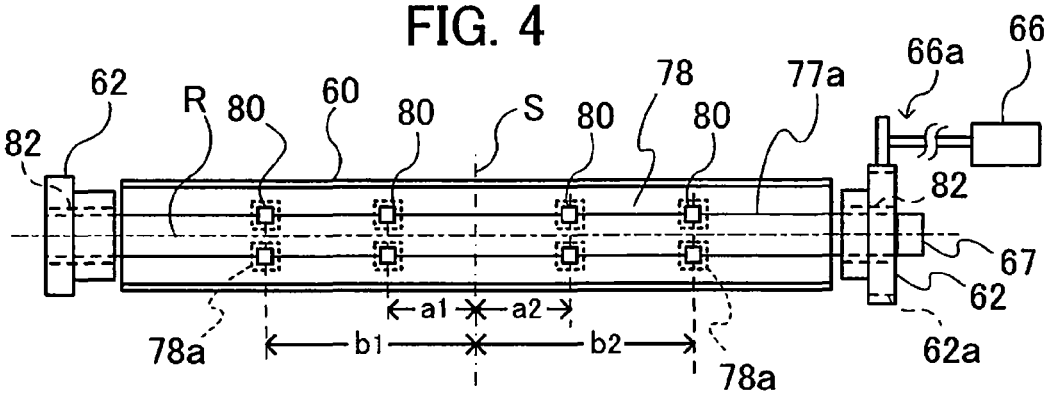
FIG. 4 is a schematic explanatory view showing arrangement of rollers inside the fixing belt.

As shown in FIG. 4, a flange 62 as an end restraining member supports an end of the fixing belt 60. The flange 62 is fitted into the inner diameter of the fixing belt 60, and keeps the end of the fixing belt 60 almost circular. The flange 62 is fixed to the inner diameter of the fixing belt 60 by, for example, an adhesive. The fixing between the flange 62 and the fixing belt 60 is not limited. The flange 62 and the fixing belt 60 are fitted to each other and caulking may be performed. For example, the flange 62 includes, at one side, a gear 62*a* to transmit driving of a drive source 66 to the fixing belt 60 through a gear group 66*a*. The fixing belt 60 rotates integrally with the flange 62. The fixing belt 60 rotates independently of the press roller 61 or is driven and rotated by the press roller 61.

The pressure pad 74 is located at a position opposite to the press roller 61 through the fixing belt 60. The pressure pad 74 presses the inner peripheral surface of the fixing belt 60 to the press roller 61 side. The pressure pad 74 presses the fixing belt 60 to the press roller 61 side, and forms a nip 76 between the fixing belt 74 and the press roller 61.

The pressure pad 74 is formed of, for example, heat resistant polyphenylene sulphide resin (PPS), liquid crystal polymer (LCP), phenol resin (PF) or the like. For example, a sheet having a good sliding property and a high abrasion resistance may be provided between the fixing belt 60 and the pressure pad 74. The friction resistance between the fixing belt 60 and the pressure pad 74 can be further reduced by applying a lubricant, such as silicone oil, between the fixing belt 60 and the pressure pad 74. A stay 75 for pad extending in the axial direction of the fixing belt 60 supports the pressure pad 74, and fixes the pressure pad 74 to the inside of the fixing belt 60. Each of both ends of the stay 75 for pad is fixed and supported by a fixed rod 67 passing through the flange 62.

The IH coil 70 includes a coil 71 and a ferrite core 72 to intensify the magnetic field of the coil 71. In the IH coil 70, a high frequency current is applied to the coil 71 to generate a magnetic flux, so that an eddy current is generated in the conductive layer 60*a* of the fixing belt 60, the conductive layer 60*a* generates heat, and the fixing belt 60 is heated.

The temperature-sensitive magnetic plate 78 as the magnetic shunt member along the shape of the fixing belt 60 is provided inside the fixing belt 60 and at a position opposite to the IH coil 70. Both ends of the temperature-sensitive magnetic plate 78 are fixed to the rods 67. The temperature-sensitive magnetic plate 78 includes a magnetic shunt metal layer of, for example, Fe—Ni alloy (permalloy) having a specified Curie temperature. The function of the temperature-sensitive magnetic plate 78 varies at the Curie temperature. If the temperature does not reach the Curie temperature, the temperature-sensitive magnetic plate 78 guides the magnetic flux from the IH coil 70 and accelerates the quick rising of the fixing belt 60. If the temperature reaches the Curie temperature, the temperature-sensitive magnetic plate 78 prevents abnormal heat generation of the fixing belt 60.

The temperature-sensitive magnetic plate 78 includes plural windows 78*a* for arranging the rollers 80. The arrangement of the windows 78*a* is symmetrical with respect to a center S of a rotation axis R of the fixing belt 60. With respect to a center line S of the fixing belt 60 of FIG. 4, a1=a2 and b1=b2 are established. The rollers 80 are arranged symmetrically with respect to the center S of the fixing belt 60, and the tensile force in the circumferential direction of the fixing belt 60 is uniformed in the longitudinal direction of the fixing belt 60. The arrangement position of the rollers 80 is not limited. The arrangement position of the rollers has only to be such that the tensile force is applied to the fixing belt 60 in the circumferential direction and fluttering of the fixing belt 60 can be prevented.

Figure 5:
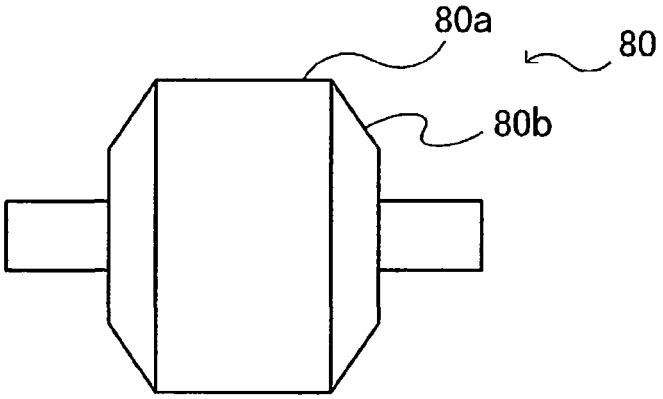
FIG. 5 is a schematic side view showing the roller of the embodiment.

The roller 80 is made of, for example, a nonmagnetic heat-resistant material such as polyether ether ketone resin (PEEK), (PPS), (LCP) or (PF). The roller 80 is not excited by the IH coil 70. As shown in FIG. 5, in order to reduce the contact area of the roller 80 with the fixing belt 60, a taper 80*b* is formed at an end of an outer peripheral surface 80*a*. Since the contact area with the fixing belt 60 is small, the roller 80 does not inhibit the temperature rising of the fixing belt 60.

The roller 80 rotatable contacts the inner peripheral surface of the fixing belt 60. A stay 77*a* for roller as a stay and a spring 77*b* for roller as an elastic member constituting the support part 77 press the roller 80 to the fixing belt 60. The spring 77*b* for roller is formed of a nonmagnetic material such as stainless. The spring 77*b* for roller causes the roller 80 to protrude from the surface of the temperature-sensitive magnetic plate 78 opposite to the fixing belt 60, and separates the fixing belt 60 from the temperature-sensitive magnetic plate 78 more certainly. The roller 80 applies the tensile force to the fixing belt 60 in the circumferential direction by the elastic force of the spring 77*b* for roller. The structure of the spring for roller is not limited and any spring such as a coil spring or a plate spring may be used.

The stay 77*a* for roller extends in the axial direction of the fixing belt 60. The fixed rod 67 fixes and supports both the ends of the stay 77*a* for roller. The roller 80 is not elastically supported by the spring 77*b* for roller, but may be fixed to the stay 77*a* for roller. However, if the roller 80 is fixed to the stay 77*a* for roller, the outer periphery of the roller 80 protrudes to the outside from the inner peripheral surface position of the fixing belt 60. The outer periphery of the roller 80 is made to protrude to the outside from the inner peripheral surface of the fixing belt 60 and the tensile force is applied to the fixing belt 60 in the circumferential direction.

Figure 6:
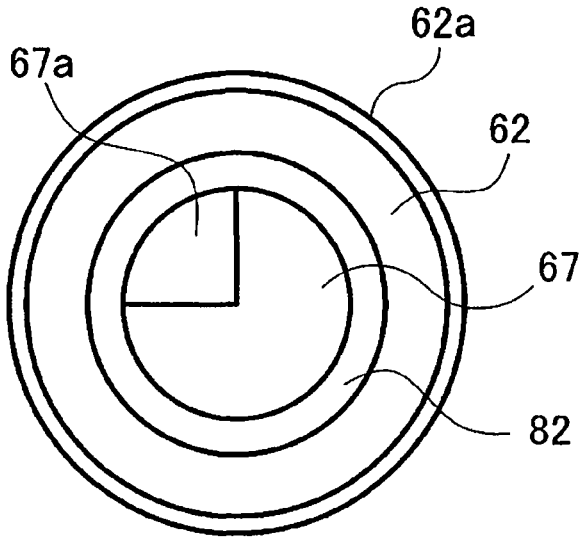
FIG. 6 is a schematic explanatory view of the fixing belt viewed from side.

The rod 67 is, for example, cylindrical, and passes through the flange 62. The flange 62 supports the rod 67 through a bearing 82. As shown in FIG. 6, the rod 67 includes a notch 67*a* at a part. The notch 67*a* prevents the air inside the fixing belt 60 from being sealed. In order to prevent the air inside the fixing belt 60 from being sealed, an air hole may be formed in the rod 67.

Figure 7:
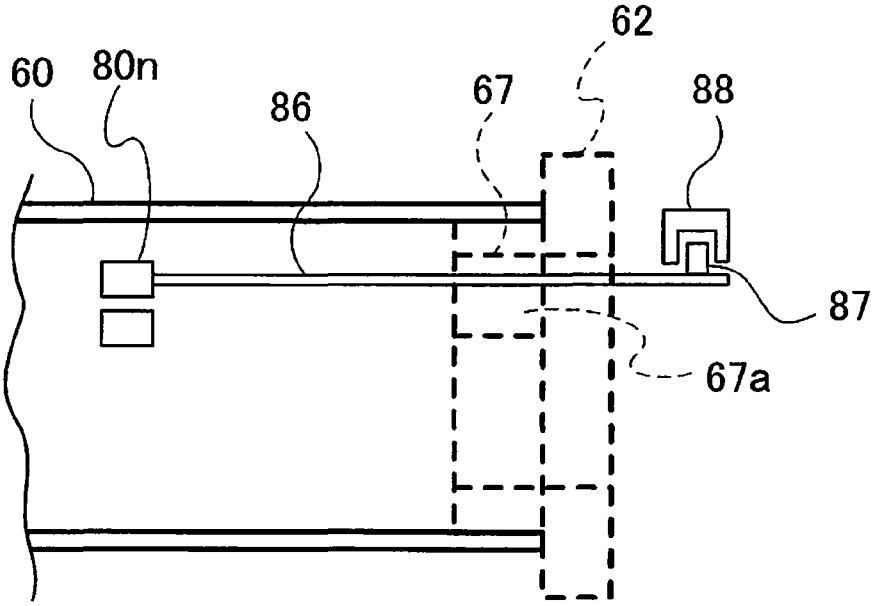
FIG. 7 is a schematic explanatory view showing a structure of a detection unit of the embodiment.

The fusing unit 32 includes a detection unit 84 to detect the rotation of the fixing belt 60. The detection unit 84 detects the rotation of the roller 80 inside the fixing belt 60, and detects the rotation of the fixing belt 60. For example, as shown in FIG. 7, a rotation shaft 86 of a roller 80*n* at the farthest end inside the fixing belt 60 is extended to the outside of the fixing belt 60 through the notch 67*a* of the rod 67. The rotation shaft 86 includes a rotor 87 at the outside of the fixing belt 60. The detection unit 84 includes, for example, a photosensor 88 to detect the rotor 87 around the fixing belt 60.

If a warming-up operation is started by turning ON a power supply, in the fusing unit 32, the conductive layer 60*a* of the fixing belt 60 generates heat by excitation of the IH coil 70. Besides, the press roller 61 applies pressure to the pressure pad 74 by the spring 63 at the time of warming-up, and rotates in an arrow x direction. The fixing belt 60 rotates in an arrow y direction by the drive source 66 through the gear group 66*a* and the gear 62*a*.

While the fixing belt 60 rotates, the flanges 62 regulate both sides of the fixing belt 60. Further, in an area of the fixing belt 60 opposite to the IH coil 70, the fixing belt 60 does not flutter and rotates in the arrow y direction while keeping a specified gap from the IH coil 70, since the roller 80 applies the tensile force to the fixing belt 60. While the fixing belt 60 rotates, the fixing belt 60 uniformly generates heat, and the fixing performance is improved, since the gap between the fixing belt 60 and the IH coil 70 is kept constant.

While the fixing belt 60 rotates, there is no fear that the inner peripheral surface of the fixing belt 60 contacts the temperature-sensitive magnetic plate 78, since the fixing belt 60 does not flutter in the area opposite to the IH coil 70. The roller 80 prevents the increase of drive torque of the fixing belt 60, the abrasion of the inner peripheral surface of the fixing belt 60 and the occurrence of shavings by the abrasion of the fixing belt 60, which are caused if the inner peripheral surface of the fixing belt 60 contacts the temperature-sensitive magnetic plate 78. The roller 80 stably rotates the fixing belt 60, prolongs the life of the fixing belt 60 and prevents the dirt due to the shavings.

The gap between the fixing belt 60 and the IH coil 70 does not slant with respect to the center S of the fixing belt 60, since the rollers 80 are arranged symmetrically with respect to the center S of the fixing belt 60. The fixing belt 60 can achieve uniform heat generation over the whole length in the longitudinal direction.

If the fixing belt 60 generates heat, the air inside the fixing belt 60 inflates. The inflated air is discharged to the outside through the notch 67*a* formed in the rod 67, and the increase of the inner pressure of the fixing belt 60 is prevented.

If the fixing belt 60 reaches the fixable temperature, the fusing unit 32 completes the warming-up and is placed in a ready mode. While the ready mode, the fusing unit 32 rotates the fixing belt 60 in the arrow y direction by the drive source 66 if required, excites the IH coil 70, and keeps the fixing belt 60 at the ready temperature. While the ready mode, the spring 63 is adjusted, and the press roller 61 reduces the pressing force of the press roller 61 to the pressure pad 74 to a pressure in the ready mode. The pressing force of the press roller 61 is reduced to prevent the fixing belt 60 or the pressure pad 74 from distorting.

While the ready mode, and while the fixing belt 60 rotates in the arrow y direction, the tensile force in the circumferential direction by the roller 80 is generated in the intermediate area of the fixing belt 60 opposite to the IH coil 70. The fixing belt 60 does not flutter, the gap between the fixing belt 60 and the IH coil 70 is kept constant, and the uniform ready temperature is kept.

If the MFP 1 starts the print operation, the fusing unit 32 fixes a toner image formed in the printer part 10 to the sheet P. The fusing unit 32 adjusts the spring 63, presses the press roller 61 to the pressure pad 74 by high pressure, and rotates the press roller in the arrow x direction. The fixing belt 60 rotates in the arrow y direction, and the fixing belt 60 generates heat at fixing temperature by the excitation of the IH coil 70.

While fixing, and the fixing belt 60 rotates in the arrow y direction, the tensile force in the circumferential direction by the roller 80 is generated in the intermediate area of the fixing belt 60, and suppresses the fluttering of the fixing belt 60. While the rotation of the fixing belt 60, the gap between the fixing belt 60 and the IH coil 70 can be kept constant, and the fixing belt 60 achieves uniform heat generation in the longitudinal direction.

If the center area of the fixing belt 60 is not regulated in the circumferential direction by the roller 80, there is a fear that the intermediate area of the fixing belt 60 distorts and fluttering occurs while the rotation. The fixing belt 60 stops rotation for a long time, and a specific part in contact with the press roller 61 is in the nip state for the long time, and as a result, even if a creep phenomenon occurs, the creep phenomenon is relieved by the roller 80.

If the center area of the fixing belt 60 is not regulated in the circumferential direction by the roller 80 and the fixing belt 60 flutters, there is a fear that the inner peripheral surface of the fixing belt 60 contacts the temperature-sensitive magnetic plate 78. If the inner peripheral surface of the fixing belt 60 contacts the temperature-sensitive magnetic plate 78, the rotation of the fixing belt becomes unstable by the increase of the drive torque of the fixing belt 60, and there is a fear that the inner peripheral surface of the fixing belt 60 is abraded, shavings occur, and the life of the fixing belt 60 becomes short.

While the fixing belt 60 rotates in the arrow y direction, the fusing unit 32 detects the rotation of the roller 80*n* at the farthest end inside the fixing belt 60. The roller 80*n* contacts the fixing belt 60, and is driven and rotated if the fixing belt 60 rotates. For example, if the fixing belt 60 is broken and stops the rotation, the roller 80*n* also stops the rotation. The detect ion unit 84 uses the photosensor 88 to detect the rotor 87 of the rotation shaft 86 rotating together with the roller 80*n*. If the photosensor 88 detects the rotation of the rotor 87, the MFP 1 recognizes that the fixing belt 60 rotates, and continues the driving of the fusing unit 32. If the photosensor 88 can not detect the rotation of the rotor 87, the MFP 1 recognizes that the fixing belt 60 is broken, and forcibly stops (down) the driving.

Since the rotation of the roller 80 driven and rotated by the fixing belt 60 is detected and the rotation of the fixing belt 60 is detected, the breakage of the fixing belt 60 can be more certainly detected. There is no fear that excitation of the IH coil 70 is continued although the fixing belt 60 does not rotate, and the fixing belt 60 locally generates heat to become hot, and the further safety of the fusing unit 32 is obtained.

According to the embodiment, in the area opposite to the IH coil 70, the roller 80 contacts the inner peripheral surface of the fixing belt 60. While the rotation of the fixing belt 60, both the sides of the fixing belt 60 are regulated by the flanges 62, and in the intermediate area of the fixing belt 60, the roller 80 applies the tensile force to the fixing belt 60 in the circumferential direction. The fluttering of the fixing belt 60 in the intermediate area is prevented while the rotation. The gap between the fixing belt 60 and the IH coil 70 is kept constant over the whole length in the longitudinal direction, and uniform heat generation of the fixing belt 60 is obtained. The inner peripheral surface of the fixing belt 60 is prevented from contacting the temperature-sensitive magnetic plate 78, the fixing belt 60 is stably rotated, and a high quality fixed image is obtained.

While certain embodiments have been described these embodiments have been presented by way of example only, and are not intended to limit the scope of the inventions. Indeed, the novel apparatus and methods described herein may be embodied in a variety of other forms: furthermore, various omissions, substitutions and changes in the form of the apparatus and methods described herein may be made without departing from the spirit of the inventions. The accompanying claims and their equivalents are intended to cover such forms of modifications as would fall within the scope and spirit of the invention.

What is claimed is:

1. A fuser comprising:

a fixing belt that is endless, includes a heat generating layer, and is configured to circulate;

an opposing unit that contacts an outer peripheral surface of the fixing belt;

a pressure unit that is disposed inside the fixing belt and located at a position opposite to the opposing unit, and presses the fixing belt towards the opposing unit such that a nip is formed between the fixing belt and the opposite part; and a plurality of rotation units that are disposed along a longitudinal direction of the nip, and contact an inner peripheral surface of the fixing belt in an area opposite to the nip and inside the fixing belt.

2. The fuser of claim 1, further comprising:

a support unit that supports at least one of the rotation units and applies a tensile force to the fixing belt in a circumferential direction through the rotation unit.

3. The fuser of claim 2, wherein the support unit includes an elastic member urging the rotation unit toward an outward direction of the fixing belt, and a stay supporting the elastic member.

4. The fuser of claim 1, further comprising:

a detection unit configured to detect rotation of one of the rotation units.

5. The fuser of claim 1, wherein the rotation units are arranged symmetrically with respect to a center of the nip in the longitudinal direction.

6. An image forming apparatus comprising:

an image forming unit configured to form an image on a recording medium;

a fixing belt that is endless, includes a heat generating layer, circulates, and contacts the recording medium so as to fix the image on the recording medium;

an opposing unit that contacts an outer peripheral surface of the fixing belt;

a pressure unit that is disposed inside the fixing belt and located at a position opposite to the opposing unit, and presses the fixing belt towards the opposing unit such that a nip is formed between the fixing belt and the opposite part; and a plurality of rotation units that are disposed along a longitudinal direction of the nip, and contact an inner peripheral surface of the fixing belt in an area opposite to the nip and inside the fixing belt.

7. The apparatus of claim 6, further comprising:

a support unit that supports at least one of the rotation units and applies a tensile force to the fixing belt in a circumferential direction through the rotation unit.

8. The apparatus of claim 7, wherein the support unit includes an elastic member urging the rotation unit toward an outward direction of the fixing belt, and a stay supporting the elastic member.

9. The apparatus of claim 6, further comprising:

a detection unit configured to detect rotation of one of the rotation units.

10. The apparatus of claim 6, wherein the rotation units are arranged symmetrically with respect to a center of the nip in the longitudinal direction.

* * * * *